US005215851A

United States Patent [19]

Tomita et al.

[11] Patent Number: 5,215,851

[45] Date of Patent: Jun. 1, 1993

[54] ELECTROPHOTOGRAPHIC TONER

[75] Inventors: Kazufumi Tomita; Yoshihiro Inaba; Koichi Takashima, all of Kanagawa, Japan

[73] Assignee: Fuji Xerox Co., Ltd., Tokyo, Japan

[21] Appl. No.: 754,662

[22] Filed: Sep. 4, 1991

[30] Foreign Application Priority Data

Sep. 5, 1990 [JP] Japan ..... 2-235130

[51] Int. Cl.[5] ..... G03G 9/00; G03G 5/00; G03C 1/72

[52] U.S. Cl. ..... 430/110; 430/109; 430/138; 430/137

[58] Field of Search ..... 430/109, 110, 904, 138, 430/137

[56] References Cited

U.S. PATENT DOCUMENTS 4,597,794 7/1986 Ohta et al. ..... 106/20
4,761,358 8/1988 Hosoi et al. .

FOREIGN PATENT DOCUMENTS 59-185353 10/1984 Japan .
59-187350 10/1984 Japan .
59-187352 10/1984 Japan .
59-187355 10/1984 Japan .
59-187357 10/1984 Japan .
59-189354 10/1984 Japan .
59-189355 10/1984 Japan .

*Primary Examiner*—Marion E. McCamish
*Assistant Examiner*—Steve Crossan
*Attorney, Agent, or Firm*—Finnegan, Henderson, Farabow, Garrett & Dunner

[57] ABSTRACT

A toner comprising capsule particles composed of a core and an outer shell wherein the capsule particles have at least a substance capable of forming a radical at the surface thereof, and the capsule particles have adhered on the outer shell a copolymer comprising a hydrophilic vinyl monomer unit and a hydrophobic vinyl monomer unit. The toner exhibits stable chargeablity against environmental changes with a narrow charge distribution.

6 Claims, No Drawings

ELECTROPHOTOGRAPHIC TONER

FIELD OF THE INVENTION

This invention relates to a toner for visualizing an electrostatic latent image in electrophotography or electrostatic printing.

BACKGROUND OF THE INVENTION

Conventional techniques for controlling charging properties of toners include incorporation of a charge control agent, e.g., nigrosine, into toner particles by melt-kneading.

It has been proposed to conduct charge control by adhering a polymer, such as an acrylonitrile polymer, a polymer having an aminophenylthio group, and a polymer of a diallylammonium halide, to the surface of the core of toner particles as disclosed in JP-A-62-106474 (the term "JP-A" as used herein means an "unexamined published Japanese patent application"), JP-A-60-26347, and JP-A-60-26346.

Toners having a charge control function on the surface thereof further include those in which a vinylpyridine polymer or a vinylimidazole polymer is present on the surface of core particles, those in which a polymer of a compound having a tertiary amine in the molecule thereof is present on the surface of core particles, and those in which a polymer of (meth)acrylonitrile, (meth-)acrylic acid, vinyl fluoride, methyl methacrylate, vinylcarbazole, vinylpyridine, dimethylaminoethyl methacrylate, diacetoneacrylamide, or N-vinylimidazole is present on the surface of core particles, as disclosed in JP-A-62-227161, JP-A-62-227162, JP-A-63-177145, JP-A-63-177147, and JP-A-63-177148.

Where a charge control agent is incorporated into toner particles, since it is only the agent present on the outer surface of toner particles that takes part in charge control, the agent must be used in large quantity.

On the other hand, where a charge control function is performed by a charge controlling polymer present on the surface of core particles, charging properties of the toner are dependent on the environmental conditions, particularly humidity because the monomer unit constituting the charge controlling polymer contains both a hydrophilic group and a charge control group per molecule. When a monomer containing both a hydrophobic group and a charge control group per molecule is used, environmental stability of the charging properties is improved, but the resulting toner shows a greatly broadened charge distribution.

SUMMARY OF THE INVENTION

An object of the present invention is to provide a toner whose charging properties are little dependent on environmental conditions and having a narrow charge distribution.

The object of the present invention is accomplished by a toner comprising capsule particles composed of a core and an outer shell, wherein said capsule particles have at least a substance capable of forming a radical at the surface thereof and, said capsule particles have adhered on the outer shell a copolymer comprising a hydrophilic vinyl monomer unit and a hydrophobic vinyl monomer unit.

DETAILED DESCRIPTION OF THE INVENTION

The terminology "substance capable of forming a radical" as used herein means a substance which undergoes a hydrogen attraction or addition reaction with a monomer radical or cerium (IV) ion to form a radical. Specific examples of such a substance include polyamide, polyurea, polyurethane, polyester, polyvinyl acetate, polyvinyl alcohol, cellulose, synthetic rubbers, polystyrene, acrylate or methacrylate (hereafter collectively referred to as "(meth)acrylate") copolymers, styrene-(meth)acrylate copolymers, epoxy resins, phenoxy resins, and acrylic resins, and mixtures of these polymers.

The substance capable of forming a radical may be uniformly present either on the entire surface of the outer shell before application of the copolymer or in spots. Alternatively, the substance may constitute the outer shell of capsule particle.

The terminology "hydrophilic vinyl monomer" as used herein means a vinyl monomer having a water solubility of at least 10 and preferably 20 or more. The term "water solubility" herein used means a maximum amount (grams) of solute to be dissolved in 100 g of water at 20° C. Specific examples of such a monomer include (meth)acrylic acid or a metal salt thereof, ethyltrimethylammonium chloride (meth)acrylate, ethyltriethylammonium chloride (meth)acrylate, triethyl(p-vinylbenzyl)ammonium chloride, trimethyl(p-vinylbenzyl)ammonium chloride, t-butylacrylamide, ethylbenzyldimethylammonium chloride (meth)acrylate, acrylonitrile, methacrylonitrile, vinylimidazole, acrolein, acrylamide, methacrylamide, allyl alcohol, methallyl alcohol, allylamine, methallylamine, diallylamine, 2-methacryloyloxyethylsuccinic acid or a metal salt thereof, ethylenesulfonic acid or a metal salt thereof, fumaric acid or a metal salt thereof, itaconic acid or a metal salt thereof, maleic acid or a metal salt thereof, vinylacetic acid or a metal salt thereof, and styrenesulfonic acid or a metal salt thereof. Examples of the metal salts as described above include sodium salts, potassium salts, carcium salts, magnecium salts and zinc salts which have the water solubility of at least 10.

The terminology "hydrophobic vinyl monomer" as used herein means a vinyl monomer having the water solubility of less than 10 and preferably 5 or less. Specific examples of such a monomer include vinylidene chloride; allyl chloride and methallyl chloride; (meth)acrylates, e.g., methyl (meth)acrylate, ethyl (meth)acrylate, propyl (meth)acrylate, butyl (meth)acrylate, pentyl (meth)acrylate, hexyl (meth)acrylate, lauryl (meth-)acrylate, trifluoroethyl methacrylate, cyclohexyl (meth)acrylate, 2-ethylhexyl (meth)acrylate, benzyl (meth)acrylate, hydroxyethyl (meth)acrylate, hydroxypropyl (meth)acrylate, 2-ethoxyethyl (meth)acrylate, glycidyl (meth)acrylate, and phenyl (meth)acrylate; vinyl-containing cyano compounds, e.g., cyanostyrene; fatty acid vinyl esters, e.g., vinyl formate, vinyl acetate, vinyl chloroacetate, vinyl propionate, vinyl butyrate, vinyl trimethylacetate, vinyl benzoate, vinyl caproate, vinyl caprylate, and vinyl stearate; vinyl ethers, e.g., ethyl vinyl ether, propyl vinyl ether, butyl vinyl ether, hexyl vinyl ether, 2-ethylhexyl vinyl ether, and phenyl vinyl ether; vinyl ketones, e.g., phenyl vinyl ketone; and vinyl aromatic compounds, e.g., styrene, chlorostyrene, hydroxystyrene, α-methylstyrene, and vinylpyridine.

In the present invention, a charge control group must be present on either one or both of the above-described hydrophilic vinyl monomer and hydrophobic vinyl monomer. Charge control groups to be used in positively chargeable toners include nitrogen-containing groups and silicon-containing groups, such as an ammonium group, an amino group, an amido group, a trialkylsilane group, and a trialkoxysilane group. Those to be used in negatively chargeable toners include a halogen atom, a carboxyl group, a sulfo group, a cyano group, and a hydroxy group.

Where the toner of the present invention is used as a positively chargeable toner, it is recommended to use a vinyl monomer having a quaternary ammonium salt structure as a charge control group.

Where the toner is used as a negatively chargeable toner, it is recommended to use a hydrophobic vinyl monomer having a halogen atom, e.g., a fluorine atom or a chlorine atom, as a charge control group.

The hydrophilic vinyl monomer is usually used in a proportion of from 0.01 to 50 mol %, and preferably from 0.1 to 40 mol %, based on the total with the hydrophobic vinyl monomer. Within such a proportion, charging properties stable against different environmental conditions and a satisfactory charge distribution can be assured.

The terminology "adhered" as used for the relation between the surface of capsule particles and the copolymer means that the above-described copolymer is bonded to the surface of capsule particles through physical or chemical bonding and does not release therefrom during development.

It is particularly preferable that the copolymer is chemically bonded to the surface of toner particles by, for example, graft polymerization so as not to release therefrom.

The toner of the present invention has a particle diameter usually of from 4 to 30 μm, and preferably of from 6 to 18 μm.

The toner of the present invention has a so-called capsule structure composed of a core and an outer shell.

The core particles have an average particle size usually ranging from 2 to 30 μm, and preferably from 4 to 18 μm.

In the capsule structure, the outer shell is a very thin coating layer, making it difficult to add therein a charge control agent. According to the present invention, however, charge control can easily be achieved without incorporating a charge control agent into the outer shell.

The outer shell material includes polyurea resins, polyurethane resins, polyamide resins, polyester resins, epoxy resins, epoxyurea resins, and epoxyurethane resins. In particular, a polyurea resin, a polyurethane resin, an epoxyurea resin, an epoxyurethane resin, a mixture of a polyurea resin and a polyurethane resin, or a mixture of an epoxyurea resin and an epoxyurethane resin is preferred.

It is preferable to vary the thickness of the outer shell depending on whether fixing is effected by pressure application or heat application while the thickness is generally from 0.01 to 3 μm. The kinds of the constituting components or the ratio of the components may be varied for the same purpose. For pressure fixing, the shell of the capsule usually ranges from 0.05 to 3 μm, preferably from 0.1 to 1 μm, and for heat fixing, it usually ranges from 0.01 to 3 μm, preferably from 0.05 to 2 μm.

The core substance of the capsule particles mainly comprises a pressure fixable component for pressure fixing or a heat fixable component for heat fixing. For pressure fixing, a core substance mainly comprising a binder resin, a high-boiling solvent for dissolving the binder resin, and a colorant and a core substance mainly comprising a soft solid substance and a colorant are particularly preferred. If desired, the colorant may be replaced with a magnetic powder, or for improving fixing properties additives, e.g., silicone oil, may further be added. The high-boiling solvent capable of dissolving the binder resin may be used in combination with a high-boiling solvent incapable of dissolving the binder resin.

Binder resins which can be used in the core substance are selected from known fixing resins, include acrylic ester polymers, e.g., polymethyl acrylate, polyethyl acrylate, polybutyl acrylate, poly-2-ethylhexyl acrylate, and polylauryl acrylate; methacrylic ester polymers, e.g., polymethyl methacrylate, polybutyl methacrylate, polyhexyl methacrylate, poly-2-ethylhexyl methacrylate, and polylauryl methacrylate; copolymers of an acrylate and a methacrylate; copolymers of a styrene monomer and an acrylic or methacrylic ester; polyvinyl acetate, polyvinyl propionate, polyvinyl butyrate; ethylenical polymers or copolymers, e.g., polyethylene and polypropylene; styrene copolymers, e.g., a styrene-butadiene copolymer, a styrene-isoprene copolymers, and a styrene-maleic acid copolymer; polyvinyl ether, polyvinyl ketone, polyester, polyamide, polyurethane, rubbers, epoxy resins, polyvinyl butyral, rosin, modified rosins, terpene resins, and phenolic resins, either individually or in combination thereof. Polymerization for preparing a binder resin may be preceded by encapsulation.

High-boiling solvents for dissolving the binder resin include oil-soluble solvents having a boiling point of 140° C. or higher, and preferably 160° C. or higher. Such solvents may be selected from, e.g., those listed in *Modern Plastics Encyclopedia,* "Plasticizers" (1975–1976) and those known as a core substance of pressure fixable capsule toners as disclosed in JP-A-58-145964 and JP-A-63-163373. Specific examples of suitable high-boiling solvents are phthalic esters (e.g., diethyl phthalate, dibutyl phthalate), aliphatic dicarboxylic acid esters (e.g., diethyl malonate, dimethyl oxalate), phosphoric esters (e.g., tricresyl phosphate, trixylyl phosphate), citric esters (e.g., o-acetyltriethyl citrate), benzoic esters (e.g., butyl benzoate, hexyl benzoate), fatty acid esters (e.g., hexadecyl myristate, dioctyl adipate), alkylnaphthalenes (e.g., methylnaphthalene, dimethylnaphthalene, monoisopropylnaphthalene, diisopropylnaphthalene), alkyldiphenyl ethers (e.g., o-, m-, or p-methyldiphenyl ether), higher fatty acid or aromatic sulfonic acid amides (e.g., N,N-dimethyllauroamide, N-butylbenzenesulfonamide), trimellitic acid esters (e.g., trioctyl trimellitate), diarylalkanes (e.g., diarylmethanes, e.g., dimethylphenylphenylmethane, and diarylethanes, e.g., 1-phenyl-1-methylphenylethane, 1-dimethylphenyl-1-phenylethane, 1-ethylphenyl-1-phenylethane), and chlorinated paraffins.

The soft solid substance which can be used as a core substance of pressure fixable capsule toners is not particularly limited as long as it has softness at room temperature and fixability. Preferred are polymers having a glass transition temperature of from −60° to 5° C. and mixtures of such polymers and other polymers.

Usable colorants include inorganic pigments, e.g., carbon black, red oxide, Prussian blue, and titanium oxide; azo pigments, e.g., Fast Yellow, Disazo Yellow, pyrazolone red, Chelate Red, Brilliant Carmine, and Para Brown; phthalocyanine pigments, e.g., copper phthalocyanine and metal-free phthalocyanine; and condensed polycyclic pigments, e.g., flavanthrone yellow, dibromoanthrone orange, perylene red, quinacridone red, and dioxazine violet. Disperse dyes and oil soluble dyes are also employable.

Examples of magnetic powders which may be used in the core include magnetite, ferrite, and metals (e.g., cobalt, iron, nickel) or alloys thereof.

In the preparation of capsule particles, while processes for encapsulation are not particularly restricted, encapsulation by interfacial polymerization is particularly preferred for facilitating sufficient coating and for assuring sufficient mechanical strength of the outer shell. Encapsulation by interfacial polymerization can be carried out in a known manner, for example, by a process for incorporating one component of the core substance into capsules in which other core components in a previously polymerized form, a low-boiling solvent, and a shell-forming component are charged and an outer shell is formed by interfacial polymerization or a process in which a monomer or monomers are charged and an outer shell is formed by interfacial polymerization and then the monomers are polymerized to form a core substance (see JP-A-57-79860, JP-A-58-66948, JP-A-59-148066, and JP-A-59-162562).

The effects of the present invention can be explained by the following mechanism. Where chargeability is endowed by a hydrophilic monomer having a charge control group, copolymerization with a hydrophobic monomer makes the copolymer on the toner surface hydrophobic. As a result, conductivity of the toner surface markedly reduces thereby to reduce environment dependence, particularly humidity dependence, of chargeability. If only the hydrophilic monomer having a charge control group is adhered on the capsule shell, it is difficult to give a large charge quantity to the toner particles. To the contrary, copolymerization with a hydrophobic monomer makes it possible to endow the toner particles with high chargeability. On the other hand, where chargeability is endowed by a hydrophobic monomer having a charge control group, the combined use of a hydrophilic monomer affords a copolymer having slight conductivity and accelerating exchange of charges among toner particles thereby to make the charge distribution narrow and sharp. If only the hydrophobic monomer having a charge control group is adhered to the capsule shell, the resulting toner particles hardly exchange charges among them, resulting in a broad charge distribution.

If a copolymer of a hydrophilic monomer and a hydrophobic monomer is directly adhered to the surface of core particles without coating the surface with a substance capable of forming a radical, since the core particles generally comprise a hydrophobic substance, they have good adhesion to the segment derived from the hydrophobic monomer but poor adhesion to the segment derived from the hydrophilic monomer. As a result, substances constituting the core particles tend to ooze out to cause contamination or agglomeration of toner particles. According to the present invention, the core substances can be prevented from oozing by the coat of a substance capable of forming a radical.

The present invention is now illustrated in greater detail with reference to Examples, but it should be understood that the present invention is not deemed to be limited thereto. All the percents and parts are by weight unless otherwise indicated.

EXAMPLE 1

(1) Preparation of Capsule Particles

In a mixed solvent of 60 g of dibutylnaphthalene and 60 g of ethyl acetate were dissolved 30 g of polyisobutyl methacrylate ($Mw=16\times10^4$) and 40 g of a styrene-n-butyl methacrylate copolymer ($Mw=6\times10^4$). To the solution was added 120 g of a magnetic powder "EPT-1000" (produced by Toda Kogyo K.K.), and the mixture was dispersed in a ball mill for 16 hours. To 200 g of the resulting dispersion were added 30 g of an isocyanate "Sumidur L" (produced by Sumitomo Bayer Urethane K.K.) and 24 g of ethyl acetate, followed by thoroughly mixing. The resulting liquid was designated liquid A.

Separately, 10 g of hydroxypropylmethyl cellulose "Metholose 65H50" (produced by Shin-etsu Chemical Industry Co., Ltd.) was dissolved in 200 g of ion-exchanged water, followed by cooling to 5° C. The resulting liquid was designated liquid B.

Liquid B was agitated in an emulsifier "Autohomomixer" (manufactured by Tokushuki Kako K.K.), and liquid A was slowly poured therein to conduct emulsification to prepare an O/W emulsion of oil droplets having a mean particle size of about 12 μm. The emulsion was then stirred in a stirrer equipped with a propeller blade "Three-One Motor" (manufactured by Shinto Kagaku K.K.) at a speed of 400 rpm. Ten minutes later, 100 g of a 5% diethylenetriamine aqueous solution was added thereto dropwise. After completion of the dropwise addition, the mixture was heated to 60° C. for 3 hours to conduct encapsulation. After completion of the reaction, the reaction mixture was poured into 2 liters of ion-exchanged water, thoroughly stirred, and allowed to stand. The supernatant liquor was removed, and the sedimented capsule particles were repeatedly washed with ion-exchanged water 7 more times in the same manner as above. Ion-exchanged water was added to the finally obtained capsule particles containing an oily binder encapulated with a polyurea resin to prepare a capsule suspension having a solids content of 40%.

(2) Preparation of Toner

To 125 g of the capsule dispersion prepared in (1) above (corresponding to 50 g of capsule particles) was added 125 g of ion-exchanged water, and the mixture was stirred in a stirrer "Three-One Motor" at a speed of 200 rpm. Five grams of 1N nitric acid and 4 g of a 10% cerium sulfate aqueous solution were added thereto, and 0.5 g of ethylene glycol dimethacrylate was then added thereto, followed by reacting at 15° C. for 3 hours. After completion of the reaction, the reaction mixture was poured into 1 liter of ion-exchanged water, thoroughly stirred, and allowed to stand. The supernatant liquor was removed, and the sedimented capsule particles were repeatedly washed 2 more times in the same manner as above to obtain capsule particles having ethylene glycol dimethacrylate graft-polymerized on the outer shell thereof. The resulting capsule particles were re-suspended in ion-exchanged water and stirred in Three-One Motor at a speed of 200 rpm. To the mixture were successively added 0.4 g of potassium persulfate, 0.1 g of triethylammoniumethyl methacrylate chloride, 1 g of methyl methacrylate, and 0.16 g of sodium hydrogensulfite, followed by allowing the mixture to react at 25° C. for 3 hours. After completion of the reaction, the reaction mixture was poured into 2 liters of ion-exchanged water, thoroughly stirred, and allowed to stand. The supernatant liquor was removed, and the sedimented capsule particles were repeatedly washed 4 more times in the same manner as above to obtain capsule toner particles having triethylammoniumethyl methacrylate chloride and methyl methacrylate graft-copolymerized on the outer shell thereof. The resulting capsule suspension was spread in a stainless steel-made vat and dried in a drier (produced by Yamato Kagaku K.K.) at 60° C. for 10 hours.

(3) Evaluation Test

Three grams of the capsule toner obtained in (2) above and 100 g of an iron powder carrier having coated thereon a phenolic resin were mixed in an atmosphere of 20° C. and 50% RH. The quantity of charge of the capsule toner was found to be 20 μC/g as measured by a blow-off method (hereinafter the same). When the mixing was conducted in an atmosphere of 28° C. and 80% RH, the charge quantity was 19 μC/g, and the charge distribution was proved sharp. Then, 100 parts of the toner was sufficiently mixed with 1 part of hydrophobic silica "RA200H" (produced by Nippon Aerosil K.K.), and subjected to copying test under a high temperature and high humidity condition (35° C., 85% RH) by the use of a copying machine ("2700" manufactured by Fuji Xerox Co., Ltd. and modified for capsule toners; reversal development). As a result, 20,000 copies free from fog were obtained in a stable manner.

COMPARATIVE EXAMPLE 1

Capsule toners having triethylammoniumethyl methacrylate chloride graft-polymerized on the outer shell thereof were produced in the same manner as in Example 1, except for replacing 0.1 g of triethylammoniumethyl methacrylate chloride and 1 g of methyl methacrylate with 1 g of triethylammoniumethyl methacrylate chloride. Three grams of the resulting capsule toner were mixed with 100 g of an iron powder carrier having coated thereon a phenolic resin were mixed in an atmosphere of 20° C. and 50% RH. The quantity of charge of the capsule toner was found to be 10 μC/g. When the mixing was conducted in an atmosphere of 28° C. and 80% RH, the charge quantity was 4 μC/g. Then, 100 parts of the toner was sufficiently mixed with 1 part of hydrophobic silica "RA200H", and subjected to copying test in the same manner as in Example 1. As result, images obtained from the 1,000th copy suffered from fog, and the 2,000th copy had a reduced image density, seriously lacking clearness.

EXAMPLE 2

Capsule toners having vinylidene chloride and methacrylic acid graft-polymerized on the outer shell thereof were produced in the same manner as in Example 1, except for replacing 0.1 g of triethylammoniumethyl methacrylate chloride and 1 g of methyl methacrylate with 0.95 g of vinylidene chloride and 0.5 g of methacrylic acid. Three grams of the resulting capsule toner were mixed with 100 g of an iron powder carrier having coated thereon a phenolic resin were mixed in an atmosphere of 20° C. and 50% RH. The quantity of charge of the capsule toner was found to be −25 μC/g. When the mixing was conducted in an atmosphere of 28° C. and 80% RH, the charge quantity was −23 μC/g, and the charge distribution was proved sharp. Then, 100 parts of the toner was sufficiently mixed with 1 part of hydrophobic silica "RA200H", and subjected to copying test in the same manner as in Example 1. As result, 20,000 copies free from fog were obtained in a stable manner.

COMPARATIVE EXAMPLE 2

Capsule toners having vinylidene chloride graft-polymerized on the outer shell thereof were produced in the same manner as in Example 2, except for replacing 0.95 g of vinylidene chloride and 0.5 g of methacrylic acid with 1 g of vinylidene chloride. Three grams of the resulting capsule toner were mixed with 100 g of an iron powder carrier having coated thereon a phenolic resin were mixed in an atmosphere of 20° C. and 50% RH. The quantity of charge of the capsule toner was found to be −25 μC/g with a very broad charge distribution. When the mixing was conducted in an atmosphere of 28° C. and 80% RH, the charge quantity was −23 μC/g with a very broad charge distribution. Then, 100 parts of the toner was sufficiently mixed with 1 part of hydrophobic silica "RA200H", and subjected to copying test in the same manner as in Example 1. As result, copies obtained from the very beginning suffered from fog, and the 1,000th copy had a reduced image density, seriously lacking clearness.

As described and demonstrated above, the electrophotographic toner according to the present invention comprises a core particle and an outer shell having adhered thereon a copolymer containing a hydrophilic monomer having a charge control agent and a hydrophobic monomer or a copolymer of a hydrophobic monomer having a charge control agent and a hydrophilic monomer. Attributed to such a structure, stability of chargeability against environmental changes and sharpness of charge distribution can be enhanced.

While the invention has been described in detail and with reference to specific examples thereof, it will be apparent to one skilled in the art that various changes and modifications can be made therein without departing from the spirit and scope thereof.

What is claimed is:

1. A toner comprising capsule particles composed of a core and an outer shell wherein said capsule particles have at least a substance capable of forming a radical at the surface thereof, and said capsule particles have adhered on the outer shell a copolymer comprising a hydrophilic vinyl monomer unit and a hydrophobic vinyl monomer unit.

2. The toner as claimed in claim 1, wherein said substance capable of forming a radical is selected from the group consisting of polyamide, polyurea, polyurethane, polyester, polyvinyl acetate, polyvinyl alcohol, cellulose, synthetic rubbers, polystyrene, acrylate copolymers, methacrylate copolymers, styren-acrylate copolymers, styrene-methacrylate copolymers, epoxy resins, phenoxy resins, and acrylic resins, and a mixture thereof.

3. The toner as claimed in claim 1, wherein said copolymer is adhered on the capsule particles through graft polymerization.

4. The toner as claimed in claim 1, wherein at least one of said hydrophilic vinyl monomer unit and said hydrophobic vinyl monomer unit contains a charge control group.

5. The toner as claimed in claim 4, wherein said charge control group is selected from the group consisting of an ammoniumyl group, an amino group, an amido group, a trialkylsilane group, a trialkoxysilane group, a halogen atom, a carboxyl group, a sulfo group, a cyano group, and a hydroxy group.

6. The toner as claimed in claim 1, wherein the proportion of said hydrophilic vinyl monomer unit is from 0.01 to 50 mol % based on the total monomer unit of the copolymer.

* * * * *

UNITED STATES PATENT AND TRADEMARK OFFICE

CERTIFICATE OF CORRECTION

PATENT NO. : 5,215,851

DATED : June 01, 1993

INVENTOR(S) : Kazufumi Tomita et al.

It is certified that error appears in the above-indentified patent and that said Letters Patent is hereby corrected as shown below:

Column 8, claim 2, line 58, change "styren" to --styrene--

Signed and Sealed this

Twelfth Day of April, 1994

Bruce Lehman

*Attest:*

BRUCE LEHMAN

*Commissioner of Patents and Trademarks*

*Attesting Officer*